United States Patent [19]

Garofalo

[11] Patent Number: 4,834,086

[45] Date of Patent: May 30, 1989

[54] PRESSURE-REGULATING DEVICE FOR THE SECOND STAGE OF REDUCTION OF AN AIR BREATHING APPARATUS

[75] Inventor: Giovanni Garofalo, Rapallo, Italy

[73] Assignee: AMF Mares S.p.A., Rapallo, Italy

[21] Appl. No.: 148,693

[22] Filed: Jan. 26, 1988

[30] Foreign Application Priority Data

Jan. 28, 1987 [IT] Italy ..... 15116/87[U]

[51] Int. Cl.[4] ..... A62B 9/02; A62B 9/06

[52] U.S. Cl. ..... 128/205.24; 128/204.18; 128/204.26; 128/207.16

[58] Field of Search ..... 128/204.18, 204.26, 128/204.29, 205.18, 205.22, 205.24, 207.15, 207.16

[56] References Cited

U.S. PATENT DOCUMENTS 2,596,178 5/1952 Seeler ..... 128/204.29

4,094,314 6/1978 Cornec ..... 128/204.26

*Primary Examiner*—Paul T. Sewell

*Assistant Examiner*—Kimberly L. Asher

*Attorney, Agent, or Firm*—Finnegan, Henderson, Farabow, Garrett & Dunner

[57] ABSTRACT

A floating piston member formed with an axial conduit communicating with the air-feeding conduit from the first stage of reduction of an air bottle, is provided at one end with a valve seat. The floating piston member may be displaced between a first operative position, in which it is pushed by air pressure against the seal of a valve member against the action of a spring, and a second position wherein it is separated and moved away from the seal of the valve member by the action of the spring. The valve member is controlled by the manostat diaphragm of the breathing apparatus, through a suitable transmission and is urged constantly toward the valve seat by a spring.

3 Claims, 1 Drawing Sheet

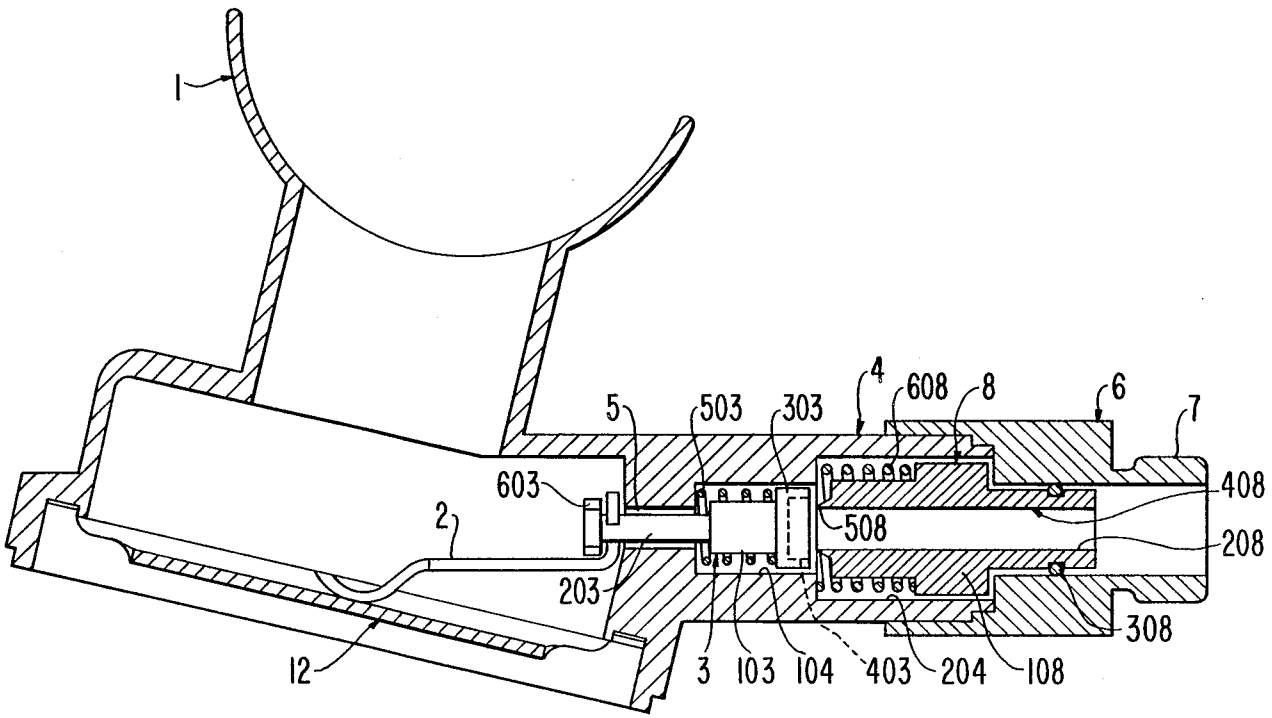
408
208
7
308
6
108
8
204
608
403
4
508
303
104
103
503
3
5
203
603
2
12
1

PRESSURE-REGULATING DEVICE FOR THE SECOND STAGE OF REDUCTION OF AN AIR BREATHING APPARATUS

BACKGROUND OF THE INVENTION

This invention relates to a pressure-regulating device which is intended, for example, to equip the second stage of reduction of a two-stage pressure regulator of an air breathing apparatus, particularly an underwater breathing apparatus.

In the conventional air pressure-regulating devices for the second stage of reduction of an air breathing apparatus, the valve member of the second-stage valve is also urged constantly by a calibrated spring with a considerable force against its valve seat. This valve-closing force is also present when the valve is in its rest condition, and in the course of time this causes a permanent distortion of the resilient seal on the valve member, which alters the calibration of valve.

Inasmuch as the rest periods of this device are by far much longer than the periods of actual operation, it has been proposed, for example, as described in U.S. Pat. No. 4,094,314, to avoid any contact between the valve member and valve seat in the second-stage valves during the non-operative periods of the valves, by mounting the valve seat on a freely-floating member or piston, whereby the valve seat is matched against the valve member only when compressed air is operative upstream of the valve seat, whereas when the supply of compressed air is discontinued the piston is pushed back into a neutral position due to the resiliency of the seal on the valve member.

The device according to said U.S. Pat No. 4,094,314 however, has some disadvantages and does not always result in a constant and reliable operation. Moreover, the force which matches the valve member against its seat cannot be adjusted.

Furthermore, all the conventional regulators mentioned above have the serious disadvantage of requiring the user, during the process of supplying air to him, to make an inhaling effort growing progressively with his air requirements. Accordingly, considerable breathing difficulties are often encountered by a user who, for example, is temporarily in a panting or gasping condition, i.e. is struggling for breath. The breathing functions of this user, in fact, are not facilitated by the conventional regulators.

SUMMARY OF THE INVENTION

This invention provides a device of the floating piston type which overcomes these and other disadvantages of the known devices.

According to its main characteristic, the floating piston of the device which mounts the valve seat, moves through an exactly-established stroke between an operative position wherein it is pushed by the pressure of the compressed air against the seal of the valve member, and a rest position, defined by a stop member, wherein the valve seat is spaced from the seal of the valve member by the action of a spring to ensure a prompt separation of these two members in any operational condition. By virtue of this characteristic, it is possible to calibrate accurately and in an exactly reproducible manner both the force for matching together the two members, i.e. the second-stage valve seat and valve member, and the force for separating them.

Due to the calibrated spring acting on the floating piston, the piston and the valve seat mounted thereon are separated from the valve member at the beginning of the breathing activity as a result of the pressure drop upstream of the piston during the inhalation step, so that an increased amount of air will be fed to the user at a parity of breathing effort. The easier breathing which results is particularly important in the case of increased need of oxygen of the user.

BRIEF DESCRIPTION OF THE DRAWING

Further characteristics and advantages of this invention will become apparent from the following description of a preferred embodiment thereof, illustrated in the accompanying drawing, which diagrammatically shows a longitudinal sectional view of a second-stage pressure regulating device according to the invention.

DESCRIPTION OF THE PREFERRED EMBODIMENT OF THE INVENTION

With reference to the drawing, the numeral 1 indicates diagrammatically the mouthpiece of a breathing apparatus, the numeral 2 indicates the control lever for a valve member 3, the lever being controlled, in a manner known per se, by a manostat diaphragm 12 of the breathing apparatus. The regulating valve for the second stage of the regulator comprises a valve body indicated generally at 4 communicating at one end thereof, through a conduit 5, with the conduit leading to the mouthpiece 1, and closed at the other end thereof by a screwed cap 6 comprising an axial tubular union 7 which is connected to the first-stage reduction valve (not shown) associated with the bottle (not shown) which feeds the compressed air. The valve body 4 comprises interiorly a first cylindrical chamber 104 and a second cylindrical chamber 204 having a larger diameter than the chamber 104. The two chambers 104 and 204 freely communicate with each other. The chamber 104 communicates at one end thereof with conduit 5, while the chamber 204 is closed at the opposite end thereof by screwed cap 6. The chamber 104 accommodates the valve member 3 comprising a cylindrical body 103 connected at one end thereof to a stem 203 which extends with a radial clearance through conduit 5 and is associated with an end of control lever 2. The body 103 is provided at the other end thereof with a member 303 accommodating the resilient seal 403 of the valve member. The outer diameter of the member 303 is smaller than the inner diameter of the chamber 104 to form an annular gap between these two members for permitting the air to flow therethrough. The valve member 3 is urged constantly in the axial direction towards the chamber 204 by a spring 503 abutting against the bottom of the chamber 104 and the bottom of the member 303. The axial displacement of the member 3 in this direction is limited by a stop member 603 arranged on the end portion of the stem 203. The chamber 204 accommodates, in an axially slidable manner, the valve-seat mounting member. This member, indicated generally at 8, comprises a cylindrical body 108 accommodated in the chamber 204, provided at one end thereof with a cylindrical extension 208 protruding into the conduit 7. A toroidal seal 308 is arranged between the outer wall of the extension 208 and the inner wall of the conduit 7 to ensure a sealed cooperation therebetween. A through-conduit 408 is formed axially in the body member 8 and communicates at one end thereof with conduit 7, and at the other end thereof with the valve seat 508. The body member 8 is urged constantly away from the valve member 3 by a spring 608 abutting against the bottom of the chamber 204 and against an annular shoulder on the body member 8.

OPERATION OF THE DESCRIBED EMBODIMENT OF THE INVENTION

The operation of the device described above is now apparent. As soon as the airflow from the first stage is activated, the air pressure acting on the end of the extension 208 pushes the body member 8 against the action of the spring 608 and matches the valve seat 508 against the valve member 3. When the user starts breathing, the valve member 3 is moved away from the valve seat 508, against the action of the valve spring 503, by the action of the lever 2 under the control of the manostat diaphragm 12. As a result, an airflow is established from the conduit 7, through the conduit 408, the valve seat 508 and conduit 5 to th mouthpiece 1. Such an airflow causes a pressure drop in the conduit 7, upstream of the piston 8, so that the floating piston 8 is again moved away from the valve member 3 (the illustrated position), thus increasing the distance between the valve seat 508 and valve member 3, which causes an increase in the amount of air fed to the user at a parity of inhaling effort. This characteristic makes breathing easier, which is particularly important in case of panting conditions or lack of oxygen.

Of course, as soon as the act of inhaling is over, pressure will increase upstream of the piston 8 and will push it back against valve member 3, thus discontinuing the airflow to the user.

Finally, when the regulator is at rest, i.e. when the airflow is discontinued from the first stage to the second stage of the regulator, the piston 8 together with the valve seat 508 are kept away from the valve member 3 by the action of the spring 608.

I claim:

1. A pressure regulating device for the second stage of reduction of an air breathing apparatus comprising:

a floating piston member disposed in an axial conduit communicating with an air feeding conduit from the first stage of reduction;

a first spring disposed in said axial conduit;

a second stage valve member disposed in the axial conduit, said valve member including a valve seal;

a valve seat mounted on said floating piston, said valve seat operative between a first position wherein it is pushed by air pressure against the valve member seal and a second position wherein it is separated and moved away from the valve member seal by the first spring, said valve seat being biased by said first spring toward the second position.

2. The device as recited in claim 1, wherein the valve member is controlled by a manostat diaphragm of the air breathing apparatus, said valve member including a second spring for urging said valve member toward the valve seat and an adjustable stop member for regulating the stroke of the valve member.

3. The device as recited in claim 1, wherein the valve member is moved away from the valve seat by inhalation of a user which causes a pressure drop upstream of the floating piston, the pressure drop causing the first spring to move the piston and valve seat away from the valve member for increasing the air flow through the axial conduit.

* * * * *